US006681712B1

(12) United States Patent
Andreae et al.

(10) Patent No.: US 6,681,712 B1
(45) Date of Patent: Jan. 27, 2004

(54) FOAM MAINTENANCE CENTER FOR PERSONAL WATERCRAFT

(75) Inventors: Ryan J. Andreae, Spirit Lake, IA (US); John E. Thompson, Spirit Lake, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/248,254

(22) Filed: Dec. 31, 2002

(51) Int. Cl.[7] ..... B63B 7/00
(52) U.S. Cl. ..... 114/343; 114/55.5
(58) Field of Search ..... 114/55.5, 343, 114/362, 363, 357; 440/6

(56) References Cited

U.S. PATENT DOCUMENTS

| | | | | | |
|---|---|---|---|---|---|
| 3,405,677 | A | * | 10/1968 | Smith | 114/55.53 |
| 3,456,613 | A | * | 7/1969 | Smith | 440/6 |
| 4,616,168 | A | * | 10/1986 | Nishida | 114/55.57 |
| 4,744,325 | A | | 5/1988 | Nobayashi | |
| 4,840,592 | A | * | 6/1989 | Anderson | 440/84 |
| 4,941,854 | A | | 7/1990 | Takahashi et al. | |
| 4,942,838 | A | | 7/1990 | Boyer et al. | |
| 5,036,789 | A | * | 8/1991 | Kelly et al. | 114/357 |
| 5,097,789 | A | * | 3/1992 | Oka | 114/363 |
| 5,255,626 | A | * | 10/1993 | Hattori et al. | 114/55.53 |
| 5,355,826 | A | * | 10/1994 | Hattori et al. | 114/55.57 |
| 5,399,111 | A | * | 3/1995 | Kobayashi et al. | 440/6 |
| 5,438,946 | A | | 8/1995 | Kobayashi | |
| 5,524,597 | A | | 6/1996 | Hiki et al. | |
| 5,669,326 | A | | 9/1997 | Ikeda | |
| 5,699,750 | A | * | 12/1997 | Schneider | 114/357 |
| 5,743,206 | A | | 4/1998 | Hattori | |
| 5,894,810 | A | | 4/1999 | Orr | |
| 5,934,953 | A | | 8/1999 | Kobayashi | |
| 6,095,876 | A | | 8/2000 | Ozawa et al. | |
| 6,112,685 | A | | 9/2000 | Matsuda et al. | |
| 6,135,832 | A | | 10/2000 | Suzuki | |
| 6,145,458 | A | | 11/2000 | Hattori | |
| 6,250,983 | B1 | | 6/2001 | Paterson | |
| 6,276,290 | B1 | | 8/2001 | Yamada et al. | |
| 6,308,650 | B1 | | 10/2001 | Tsumiyama et al. | |
| 2001/0000052 | A1 | | 3/2001 | Yamada et al. | |
| 2002/0053310 | A1 | | 5/2002 | Ibata et al. | |
| 2002/0077007 | A1 | | 6/2002 | Dagenais et al. | |

* cited by examiner

*Primary Examiner*—S. Joseph Morano
*Assistant Examiner*—Lars A. Olson
(74) *Attorney, Agent, or Firm*—Fredrikson & Byron, P.A.

(57) ABSTRACT

A housing for mounting electronic equipment in a personal watercraft, the housing including a foam piece adapted to be disposed within the hull. The foam piece can have at least one battery cavity formed therein adapted to at least partially contain a battery. The foam piece can also have at least one engine electronics control box cavity adapted to at least partially contain an engine electronics control box. The foam preferably has holes formed entirely through the foam for securing straps around the electronics using hook and loop type fasteners. The foam can be a closed cell, floatation foam. A personal watercraft can be assembled by dropping the foam into a bottom hull, inserting pre-wired devices into mounting cavities in the foam, and securing the devices by wrapping the strap free ends upon themselves. The foam maintenance center can be secured to the watercraft using an expandable material inserted between the foam and the top deck, and allowing the material to expand.

35 Claims, 9 Drawing Sheets

FOAM MAINTENANCE CENTER FOR PERSONAL WATERCRAFT

BACKGROUND OF INVENTION

1. Field of the Invention

The present invention is related generally to personal watercraft. More specifically, the present invention is related to maintenance centers that can house engine electronics within the personal watercraft. The present invention includes a maintenance center formed of flotation foam for personal watercraft.

2. Description of Related Art

Personal watercraft (PWC) have become increasingly popular in recent years. A personal watercraft, also known as a "jet ski" typically has a bottom hull, handle bars for steering, a tunnel within the bottom hull, a jet pump located within the bottom tunnel, and an engine within the hull under the top deck for driving the jet pump. The jet pump typically pulls in water from the front of the tunnel under the boat, and discharges the water at high velocity through a steerable nozzle at the rear of the boat. The handlebars are typically coupled to the nozzle, which is the steering mechanism for the personal watercraft. The watercraft commonly has a straddle-type seat and foot wells disposed on either side of the seat.

Personal watercraft typically have a top deck affixed to a bottom hull. The PWC has a shroud mounted in front of the driver on top of the top deck to house the steering column and some instruments. A front portion of the top deck includes a hinged cover or "hood." The underside of the hood can include a gasket or a grommet that attempts to provide a watertight seal between the hood and the top deck. The hood typically covers either a storage bin or an engine access port.

Present watercraft often have the battery and the electronic equipment located within the watercraft, with little thought as to the optimal location. Electronic components can be positioned in several different locations within the watercraft hull, making troubleshooting and maintenance difficult. The components can be particularly difficult to reach while the boat is out on the water.

Present watercraft often have the battery and other components secured directly or indirectly to the hull with fasteners rigidly connected to the bottom hull or top deck. Such rigid fasteners can include fasteners connected at hard points to the bottom hull, or other fasteners, either rigid or non-rigid, coupled to the fasteners coupled to the hull. The rigid connections can transmit vibration from the water pounding against the hull to the battery and other electronic components. This vibration may shorten the life of the components. Connecting the devices, directly or indirectly, to hard mounting points on the hull adds expense to the manufacturing process in hardware costs, number of parts, and complexity of manufacturing.

What would be desirable is a personal watercraft that provides easy access to most or all electronic components in a single location. What would also be desirable is a personal watercraft that allows for easier manufacturing, and does not require any hard mounting to secure the electronics to the watercraft.

SUMMARY OF INVENTION

The present invention provides a jet propelled personal watercraft including a hull, the hull having a bottom hull and a top deck secured over the bottom hull, the hull defining an engine compartment sized to contain an internal combustion engine for powering a jet propulsion unit. The personal watercraft also includes a jet propulsion unit including a steerable water discharge nozzle. The top deck can have a raised, longitudinally extending seat adapted to accommodate an operator in straddle fashion.

The personal watercraft further includes a foam maintenance center that can include a foam piece having cavities therein for housing the battery and other engine electronics. The battery, engine capacitor, any engine electronics for fuel injection, and other devices can all be located near each other in a single, accessible, vibration isolated environment in some embodiments. The foam piece can be formed of a closed cell foam and is preferably formed of floatation foam.

The personal watercraft preferably includes the battery at least partially contained within the battery cavity, and the engine control electronics box at least partially contained within the engine control electronics box cavity.

The foam can include at least one hole entirely through the foam from top to bottom, and can have at least one strap disposed through the at least one hole for securing the battery, the engine control electronics box, the engine capacitor, or other device to the foam. The strap can have free ends secured together to secure the battery to the foam using hook and loop type fasteners. In a preferred personal watercraft, the foam is not mechanically secured to the bottom hull using any fasteners that penetrate into the bottom hull. The foam can be shaped to match the inner contours of at least part of the hull.

The present invention includes a housing for electronic equipment in a personal watercraft, the housing comprising a foam piece adapted to be disposed within the hull, the foam piece having at least one battery cavity formed therein adapted to at least partially contain a battery, the foam piece having at least one engine electronics control box cavity adapted to at least partially contain an engine electronics control box. The housing foam can be a closed cell foam, preferably a closed cell flotation foam. The foam can include at least one hole entirely through the foam, and can have a securing strap disposed through the hole for securing devices to the foam. Straps can be securable upon themselves using hook and loop type fasters along the strap free ends. The foam can be shaped to match the contours of a personal watercraft bottom hull interior.

The present invention also includes a method for housing engine electronic equipment in a personal watercraft having a top deck secured to a bottom hull to form a hull interior within, the method comprising providing the personal watercraft and providing a foam piece adapted to be disposed within the hull interior space, the foam piece having at least one battery cavity formed therein adapted to at least partially contain a battery. The foam piece can also have at least one engine electronics control box cavity adapted to at least partially contain an engine electronics control box. The method also includes placing the foam piece within the hull. The method can include at least partially inserting the battery in the battery cavity and at least partially inserting the engine control electronics box in the engine control electronics box cavity. The method preferably includes securing the foam piece to the bottom hull not using fasteners that penetrate into the hull.

The present invention includes a jet-propelled personal watercraft comprising a hull including a bottom hull and a top deck secured to the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion. The watercraft can also include a battery secured to the personal watercraft, wherein the battery is secured without either directly or indirectly securing the battery to fasteners that are rigidly connected to either the hull or top deck. A preferred watercraft has the battery secured in place without being secured either directly or indirectly to fasteners that penetrate into the hull or top deck. Such a watercraft can include a foam piece disposed within the hull, the foam piece having at least one battery cavity formed therein adapted to at least partially contain a battery.

DETAILED DESCRIPTION

The following detailed description should be read with reference to the drawings, in which like elements in different drawings are numbered identically. The drawings, which are not necessarily to scale, depict selected embodiments and are not intended to limit the scope of the invention. Several forms of the invention have been shown and described, and other forms will now be apparent to those skilled in the art. It will be understood that embodiments shown in drawings and described below are merely for illustrative purposes, and are not intended to limit the scope of the invention as defined in the claims that follow.

Figure 1:
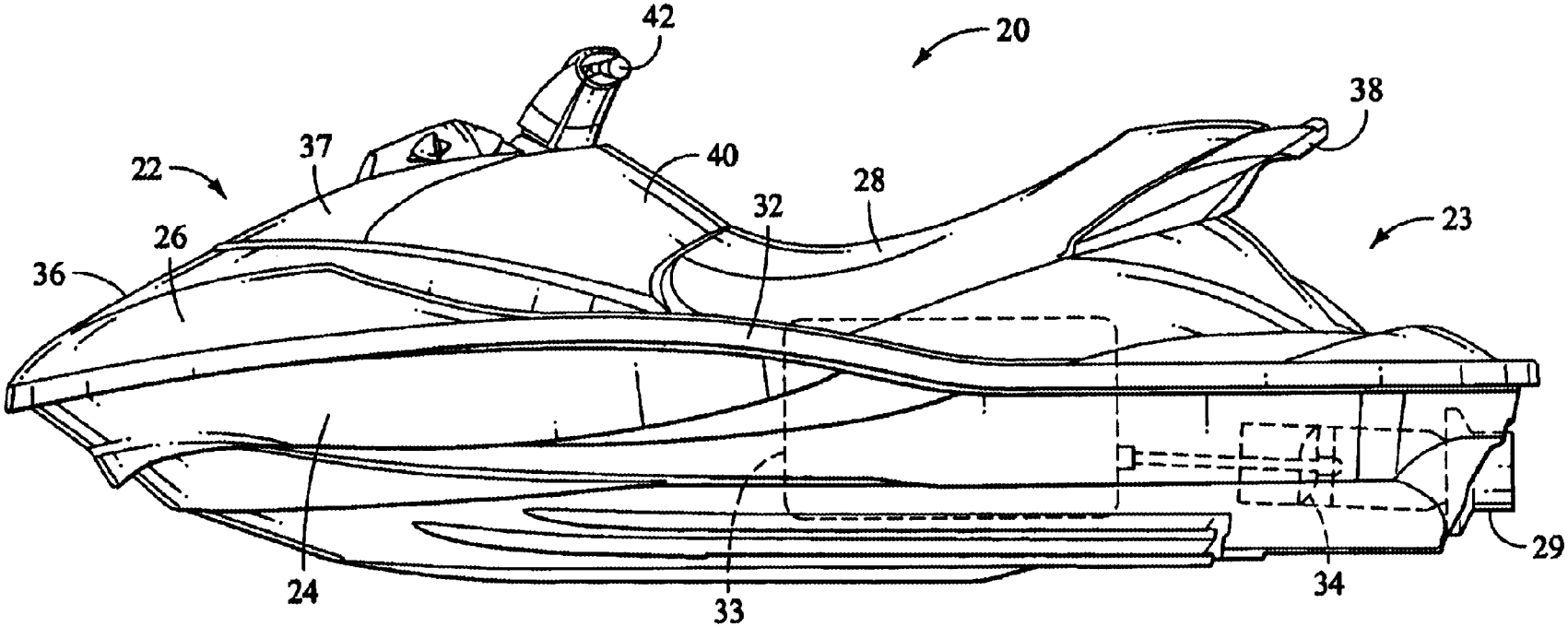
FIG. 1 is a side view of a personal watercraft.

FIG. 1 illustrates a personal watercraft 20 having generally a front or bow 22 and a rear or stern 23. Personal watercraft 20 includes a top deck 26 secured to a bottom hull 24 along an overlapping portion covered with a rub rail 32 in the embodiment illustrated, forming a hull. A hood 37 may also be seen, joined to top deck 26 at a hinged front hood portion 36. The hull formed by the bottom hull 24 and top deck 26 define a compartment sized to contain an internal combustion engine 33 for powering the watercraft, and may also include one or more storage compartments, depending upon the size and configuration of the watercraft. The deck portion 26 also has a raised, longitudinally extending seat 28 adapted to accommodate one or more riders seated in straddle fashion on the seat 28. A grab handle 38 is disposed transversely across the rear of the seat. Engine 33 powers a jet propulsion unit 34, typically mounted in a tunnel at the bottom rear portion of the watercraft, all shown in phantom in FIG. 1. Jet propulsion unit 34 includes a steerable water discharge nozzle 29 that is operatively connected to a set of handlebars 42 to facilitate steering of the watercraft by the operator. Handlebars 42 typically mount through a top portion of a shroud 40. The connection between handlebars 42 and discharge nozzle 29 may be of any suitable type, and typically includes mechanical linkages including a control cable. If desired, an electronic connection could also be utilized.

Seat 28 can be lifted and removed to expose an aperture under the seat that can provide easy access while on the water to the battery and other engine electronics. As described later, the battery and other electronics can be housed in a foam maintenance center that can be accessed by lifting the seat.

Figure 2:
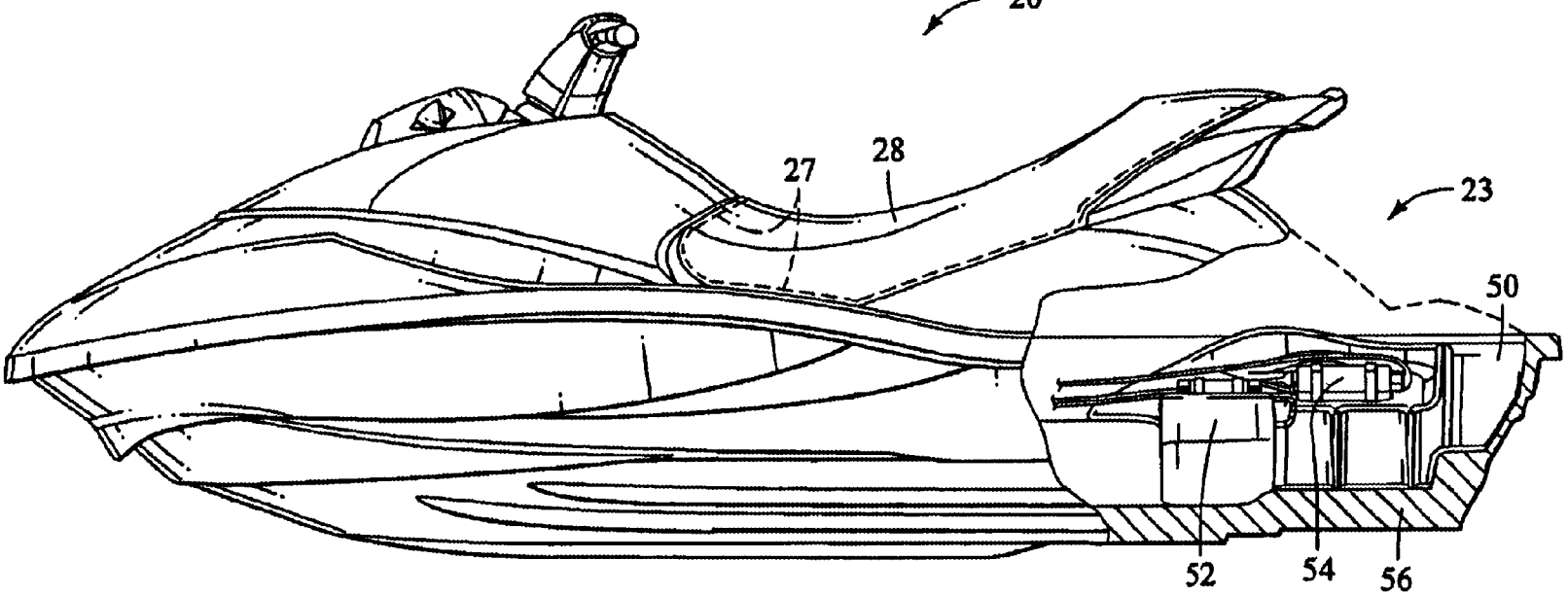
FIG. 2 is a side view of the personal watercraft of FIG. 1, cutaway to reveal the foam maintenance center on the far side.

FIG. 2 illustrates PWC 20, having the hull and propulsion unit removed to reveal a foam maintenance center (FMC) 50 on the driver's right side, the PWC starboard side. FMC 50 can be formed of a closed cell foam, most preferably a flotation foam, well known to those skilled in the art, that can be used to keep the boat afloat. While FMC is preferably a single foam piece, FMC 50 can be formed of more than one piece. Foam maintenance center 50 can be snuggly fit within the surrounding bottom hull 56 and can house a battery 52 and an Engine Maintenance Module (EMM) or Electronic Maintenance Module (EMM) 54. Inspection of FIG. 2 shows that FMC 50 can be shaped to conform to the inner contours of the surrounding hull. Seat 28 can be removed along the dashed line shown at 27 to access the engine and FMC 50 beneath.

Figure 3:
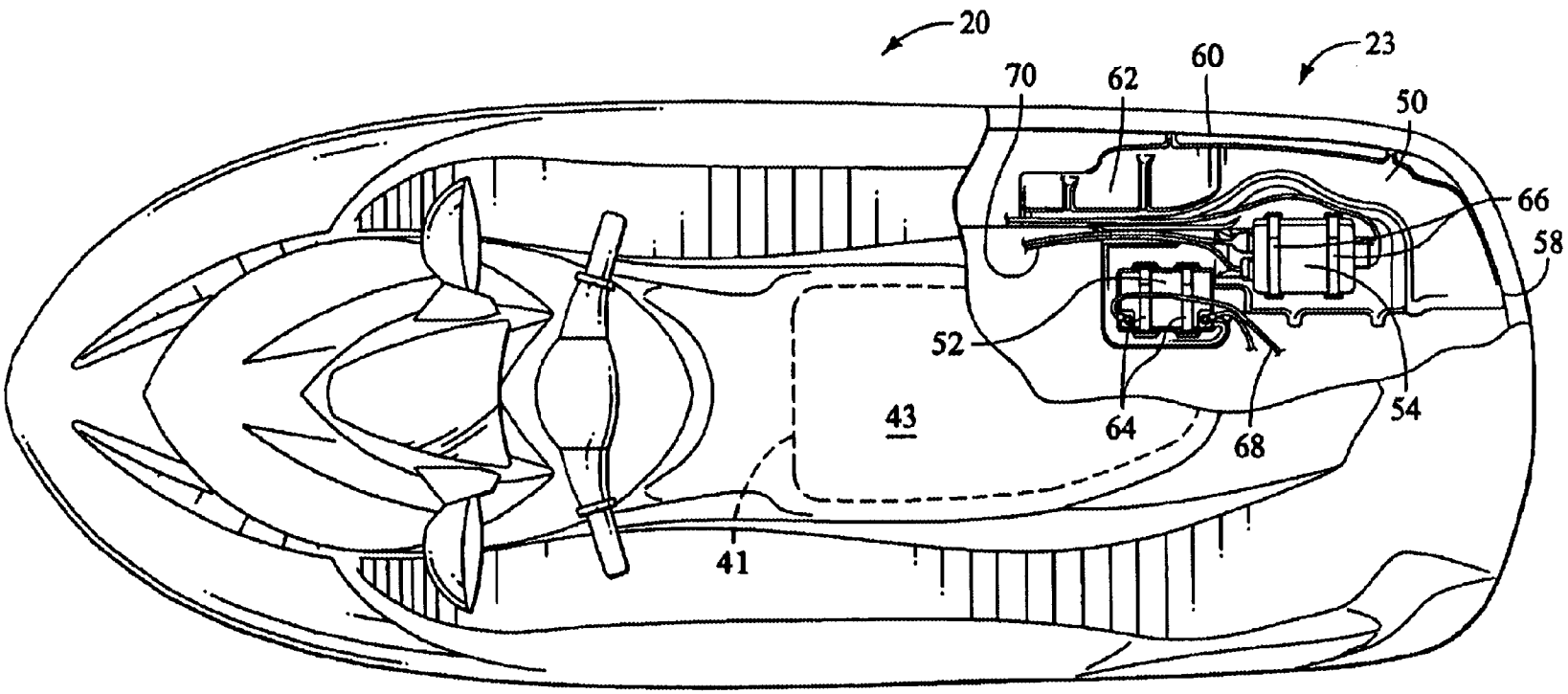
FIG. 3 is a top view of the personal watercraft of FIG. 1, cutaway to reveal the foam maintenance center.

FIG. 3 illustrates PWC 20 from the top. FMC 50 includes an outside surface 60, a rear surface 58, and a front ramp-down region 62 that descends downwardly and forwardly towards the driver's foot well area. As described below, front ramp-down area 62 can later have expandable foam placed over it, with the expanded foam pressing against the upper deck and downward against FMC 50. In one embodiment, the expanded foam is the primary mechanism for securing FMC 50 in place. Battery 52 can be held in place with battery straps 64 and be coupled to battery cables 68. EMM 54 can be held in place with EMM straps 66 and be coupled to EMM cables 70. EMM cables 70 can be coupled to the engine, fuel injectors, instrument read-outs, and other electronic devices, for example, off-throttle steering (OTS) devices. When the seat is removed, an aperture 43 is exposed, where the boundary of aperture 43 is indicated by dashed line 41. The engine and the FMC 50 can be accessed through aperture 43. As can be seen from inspection of FIG. 3, battery 52 and EMM 54 can be easily accessed through aperture 43 when the seat is removed.

Figure 4:
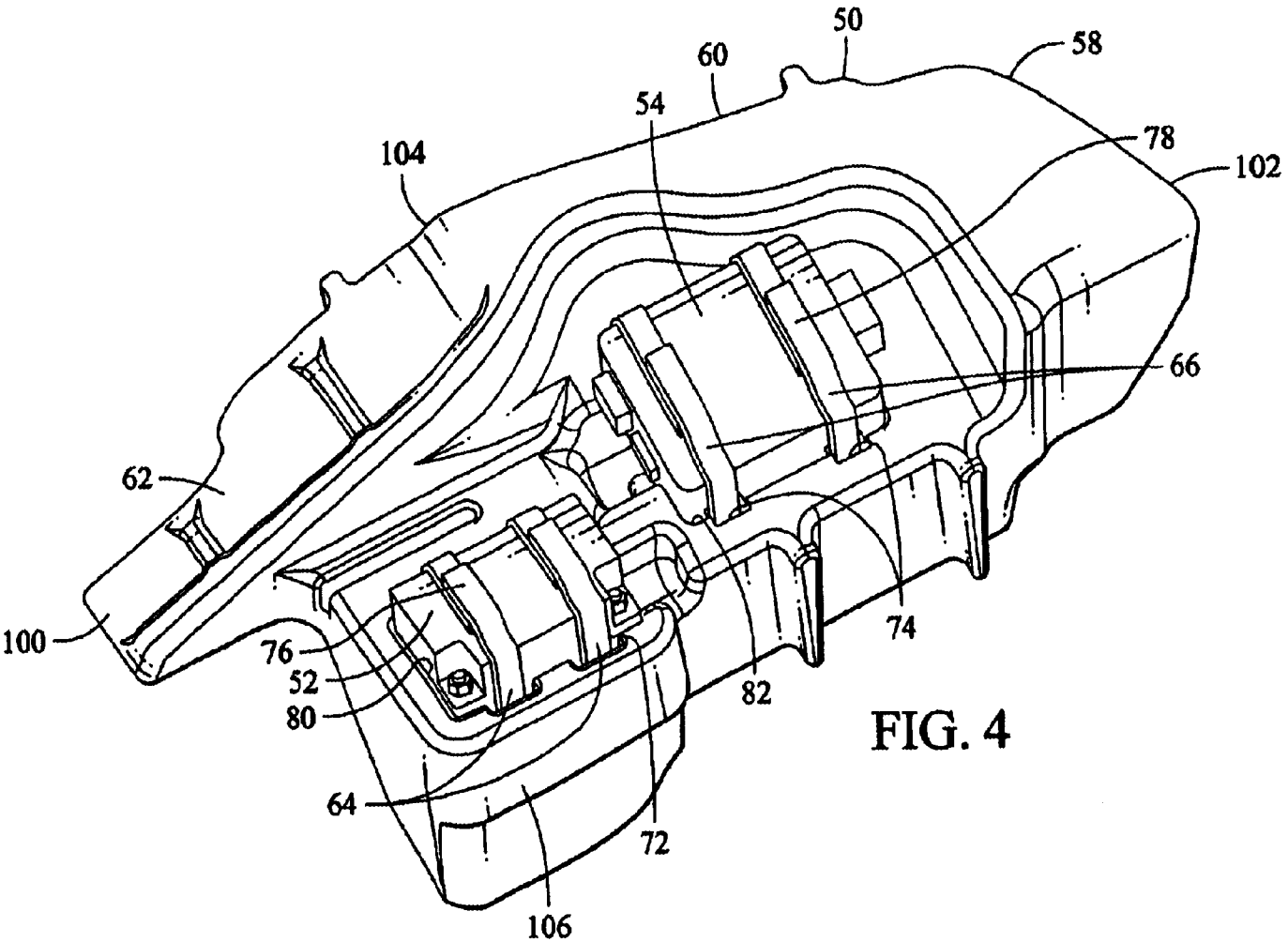
FIG. 4 is a perspective view of the foam maintenance center of FIG. 3, having the battery and EMM strapped in place.

FIG. 4 illustrates FMC 50 in a perspective view. FMC 50 may be seen to have a front-most extent 100 that can be located behind the driver foot-well. FMC 50 also has a rear surface 58, an inside surface 106, an outside-most extent 104, and a rear-most extent 102. Battery 52 can be held in place with straps 64 having an overlapping strap region 76. Battery 52 resides within a battery cavity 80 formed into the top surface of the foam. Straps 64 can lie within battery strap channels 72 formed into the sides of battery cavity 80. EMM 54 can be held in place with EMM straps 66 having an overlapping strap region 78. In a preferred embodiment, strap-overlapping regions 76 and 78 include hook and loop fasteners to secure the strap ends to each other.

One hook and loop fastener material is VELCRO®. EMM 54 can reside within an EMM cavity 82 formed into the top surface of the foam. EMM straps 66 can reside within strap channels 74 formed into the sides of EMM cavity 82. In some embodiments, EMM 54 is secured to an engine electronics control box mounting region adapted to at least partially secure an engine electronics control box, where the mounting region is not necessarily a cavity.

Figure 5:
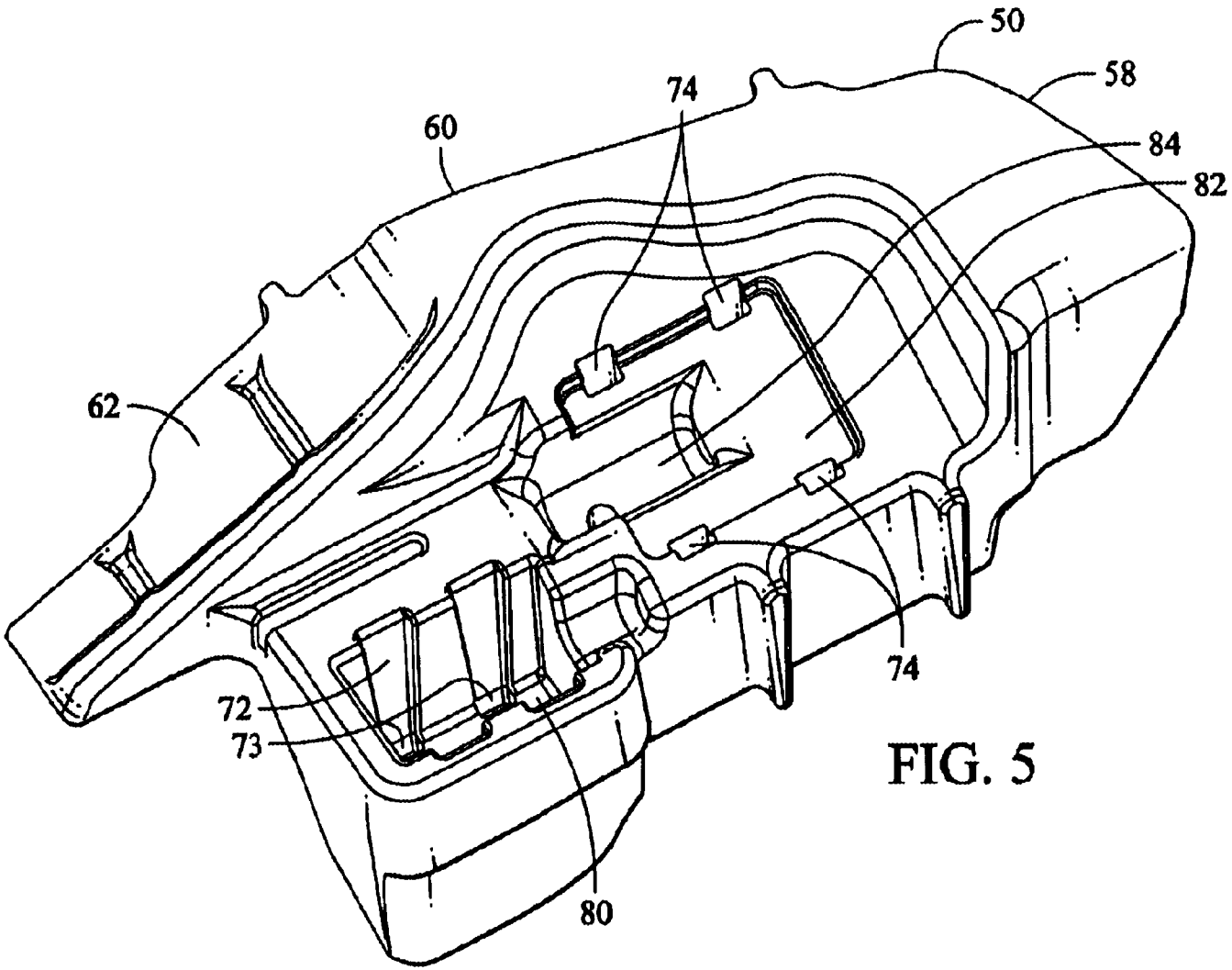
FIG. 5 is a perspective view of the foam maintenance center of FIG. 3, having the equipment removed to reveal the capacitor cavity under the EMM cavity.

FIG. 5 illustrates FMC 50 from a perspective view, having the battery and EMM removed. A capacitor cavity 84 may be seen formed into the foam. In the embodiment illustrated, capacitor cavity 84 is formed within and under EMM cavity 82. Battery cavity 80 may be seen to have strap channels 72 extending downward and through battery strap holes or apertures 73 that can extend entirely through the foam to the foam bottom.

Figure 6:
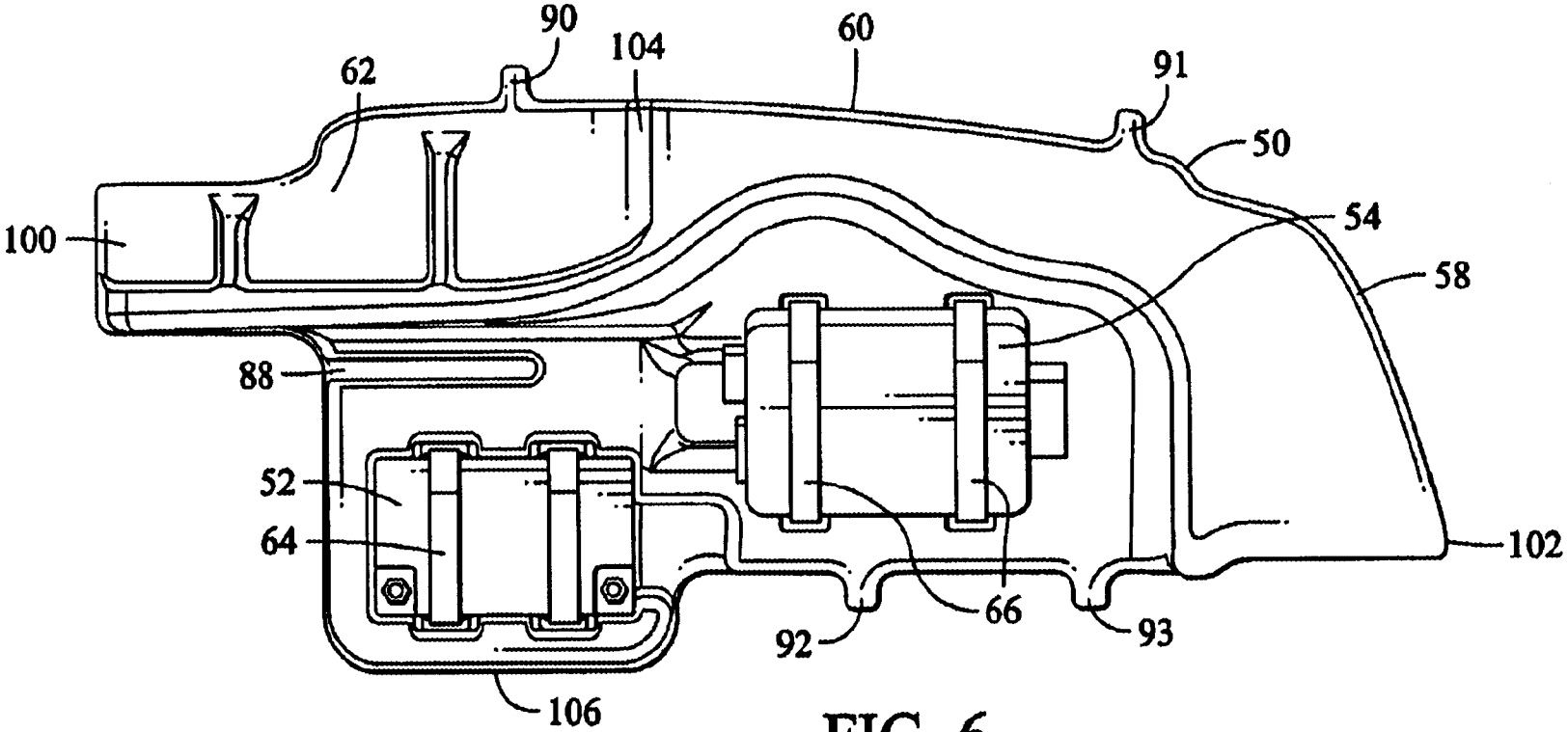
FIG. 6 is a top view of the foam maintenance center of FIG. 3, having the battery and EMM strapped in place.

FIG. 6 illustrates FMC 50 from the top, having battery 52 and EMM 54 secured in place with straps 64 and 66, respectively. FMC 50 can have outside ribs 90 and 91 protruding from outside surface 60 and inside ribs 92 and 93 protruding from inside surface 106. The foam top surface includes several surface troughs such as wireway trough 88 than can be used to dress and secure wires and cables. The foam can also hold other components, including an electronic module to implement off-throttle steering.

Figure 7:
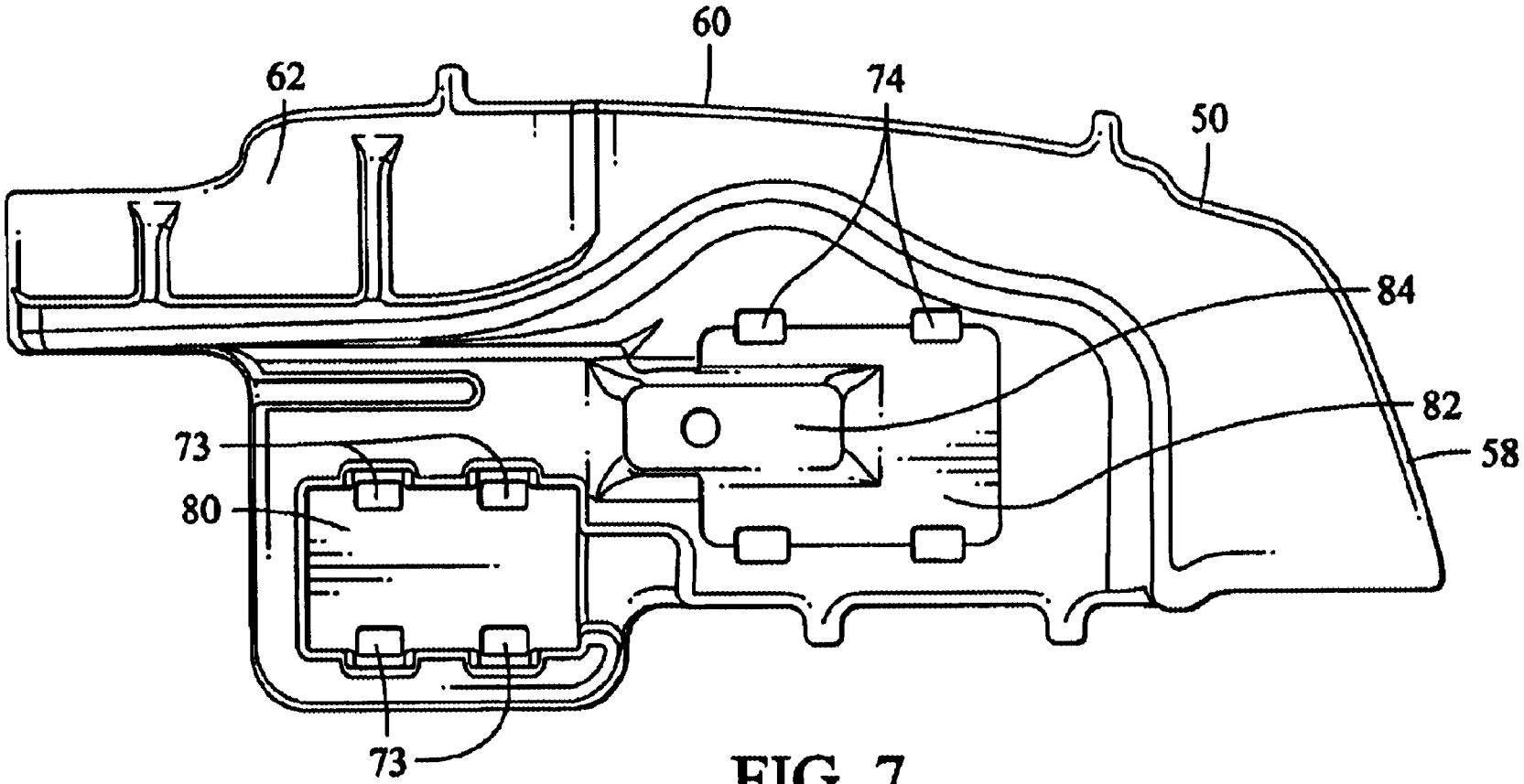
FIG. 7 is a top view of the foam maintenance center of FIG. 3, having the equipment removed to reveal the capacitor cavity under the EMM cavity.

FIG. 7 illustrates FMC 50 from the top, without the battery, EMM, or engine capacitor in place. EMM cavity 82 can include strap holes or apertures 74 formed entirely through the foam, to the bottom. Engine capacitor cavity 84 can be more clearly seen in FIG. 7, as can battery strap holes 73.

Figure 8:
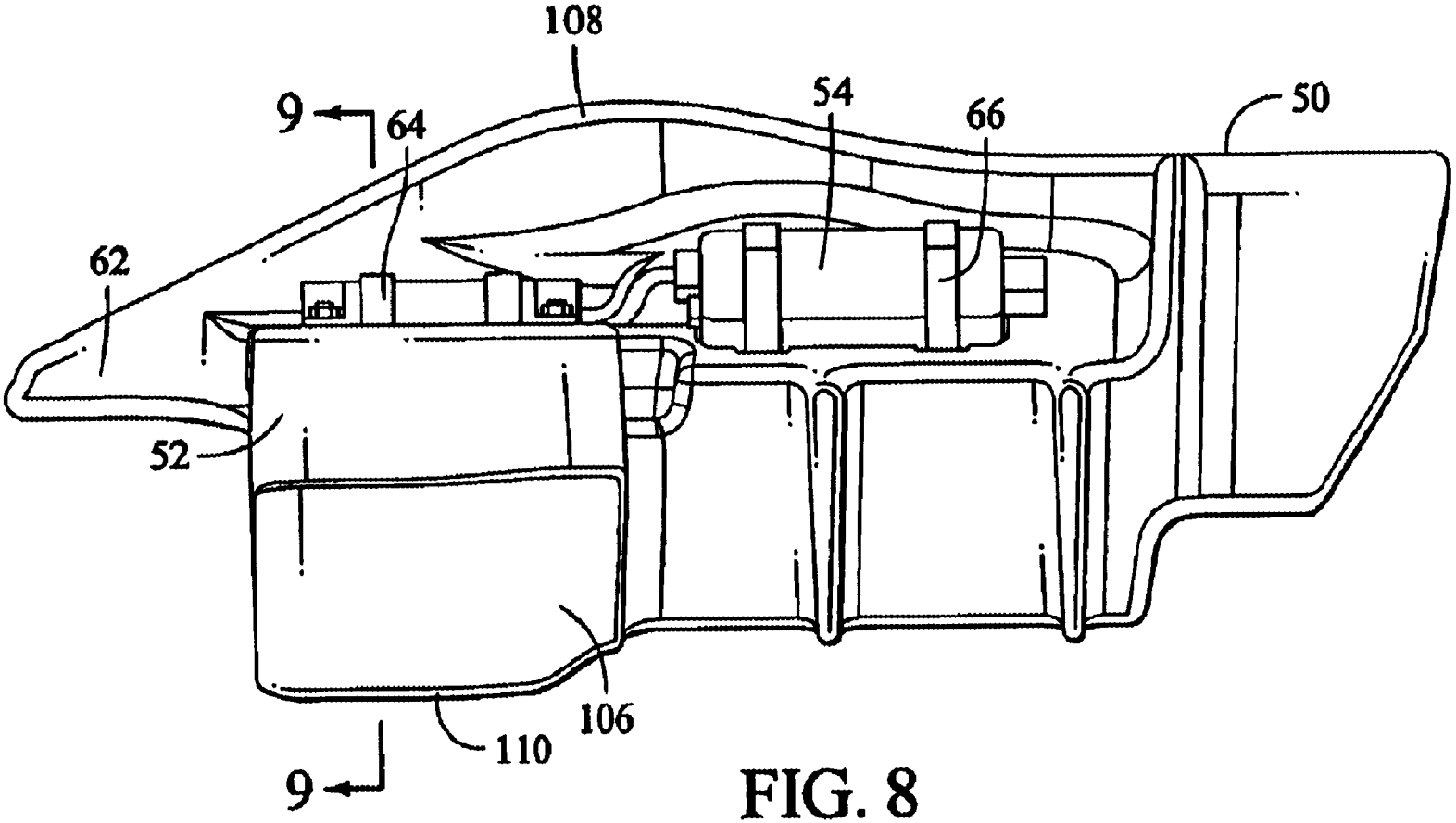
FIG. 8 is a partially cutaway side view of the foam maintenance center of FIG. 3.

FIG. 8 illustrates FMC 50 from the side, showing inside surface 106, which has been partially cut away to show battery 52. FMC 50 has a top-most extent 108 and a bottom-most extent 110, as illustrated in FIG. 8.

Figure 9:
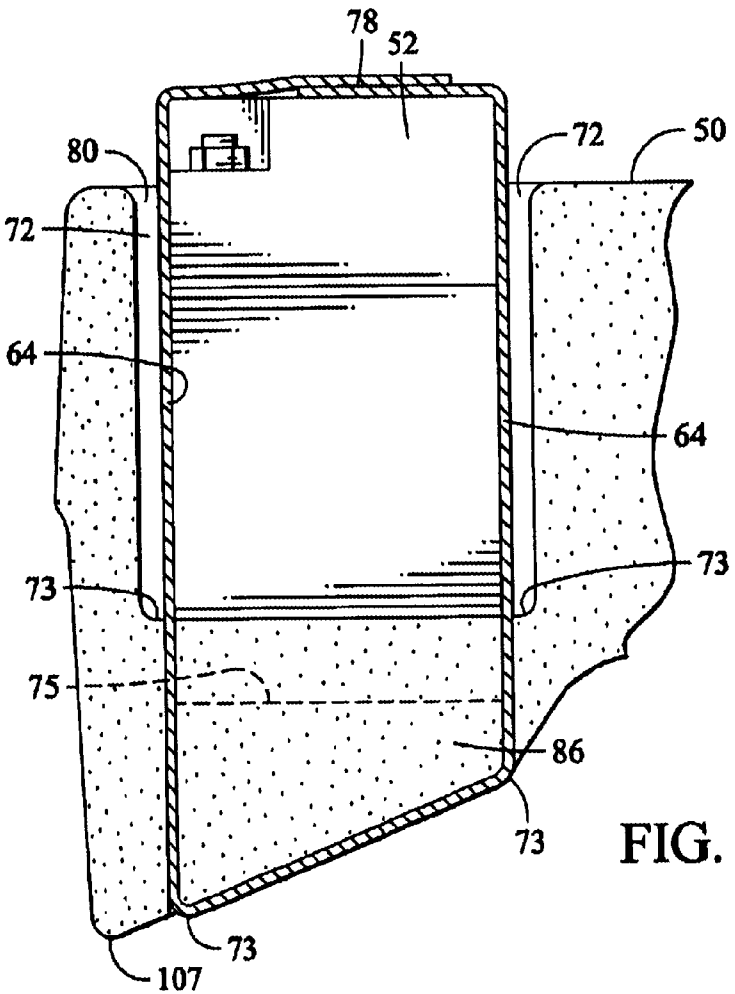
FIG. 9 is a fragmentary, front side, cutaway view of the battery strapped in a foam cavity.

FIG. 9 illustrates FMC 50 from the front side, including battery 52 held in place by straps 64 that extend along channels 72 in battery cavity 80 and downward through strap bottom holes 73 that extend entirely through the foam to a foam bottom surface 107. In another embodiment, straps 64 are threaded through holes that extend only partially into the foam and join under the battery, as indicated by a path 75 shown in FIG. 9.

The use of FMC 50 can reduce the cost of manufacturing a PWC and can also reduce the time required to assemble the PWC. In one method of manufacturing a PWC, the bottom hull is provided, and the engine dropped in, followed by the pump and fuel tank. The exhaust system can then be installed. The foam maintenance center can then be dropped into the bottom hull. In some methods, straps are already threaded down through holes in the foam and up through other holes in the foam, leaving the two free ends loose. In some methods, the FMC is empty of devices at this point. The battery, engine capacitor, EMM, and any other electronic boards or boxes can be put into their respective cavities after the foam is put into the bottom hull in other methods. The battery, EMM, and other devices can be secured in place by simply wrapping the free ends of the straps around the devices and allowing the Velcro® or other hook and loop fasteners to take hold. In other methods, the FMC is pre-loaded with the battery and EMM. In some methods, some or all of the battery, capacitor, EMM, and other electronics are already coupled to their respective wires or cables. The cables can then be coupled to their proper termination points on the engine and any other locations and electrical checks performed.

In one method, adhesive or glue is deposited on the portions of the top deck that are to adhere to the bottom hull. An expandable device or material can be put near the foam, at an appropriate location or locations. In one method, an expandable material is put on a top region of the foam maintenance center, near the foot well area, to later expand upward against the top deck and downward against the foam maintenance center, holding the foam in place. In some methods, the expandable material is put along the foam maintenance center side surfaces or bottom surface. In a preferred method, the expandable material is expandable foam injected into an enclosing bag. One such expandable foam is a packing foam, similar to that used for protecting goods during shipping. The foam filled bag can then be put against the FMC. In one method, the top deck is lowered onto the bottom hull before the expanding material has fully expanded, and the top deck secured to the bottom hull.

The foam maintenance center can provide several advantages, depending on the embodiment used. The FMC can provide a vibration isolating mounting environment for the battery, capacitor, EMM, and other electronics. The FMC can also provide an easily accessibly, single location where the battery and engine electronics can be serviced and troubleshot, even on the water. In some embodiments, this is accomplished by simply raising the seat to expose the FMC disposed below the open seat aperture. The foam and the housed devices are preferably not mechanically secured to the hull or top deck using any fasteners secured into the hull or deck at hard mounting points. As used herein, "hard mounting points" include bolts, screws, rivets, or other fasteners penetrating into the hull, deck, or any other rigid bodies that are rigidly secured to the hull or deck. The lack of such fasteners penetrating into the hull or deck, either directly or indirectly, also simplifies assembly and reduces the number of parts required to manufacture the personal watercraft.

What is claimed is:

1. A jet-propelled personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat ad ed to accommodate an operator in straddle fashion; and a foam piece disposed within the hull, the foam piece having at least one battery cavity formed therein adapted to at least partially contain a battery, the foam piece having at least one engine electronics control box mounting region adapter to at least partially secure an engine electronics control box.

2. A personal watercraft as in claim 1, further comprising a battery at least partially contained within the battery cavity.

3. A personal watercraft as in claim 1, further comprising an engine control electronics box at least partially contained within the engine electronics control box mounting region.

4. A personal watercraft as in claim 1, wherein the foam is a closed cell foam.

5. A personal watercraft as in claim 1, wherein the foam is a closed cell flotation foam.

6. A personal watercraft as in claim 1, wherein the foam includes at least one hole entirely through the foam.

7. A personal watercraft as in claim 6, wherein the foam includes at least one strap disposed through the at least one hole.

8. A personal watercraft as in claim 1, wherein the foam includes at least one strap secured to the foam.

9. A personal watercraft as in claim 8, wherein the strap secures upon itself to secure the battery to the foam using hook and loop type fasteners.

10. A personal watercraft as in claim 1, wherein the foam is not mechanically secured to the bottom hull using any fasteners that penetrate into the bottom hull.

11. A personal watercraft as in claim 1, wherein the foam is shaped to match the inner contours of at least part of the hull.

12. A personal watercraft as in claim 1, wherein the battery cavity and engine control box region are both accessible by lifting the seat.

13. A housing for electronic equipment in a personal watercraft, the housing comprising:

a foam piece adapted to be disposed within a hull, the foam piece having at least one battery cavity formed therein adapted to at least partially contain a battery, the foam piece further comprising at least one engine electronics box mounting region for at least partially containing an engine electronics control box.

14. A housing for electronic equipment in a personal watercraft as in claim 13, wherein the foam is shaped to match the contours of a personal watercraft bottom hull interior.

15. A housing for electronic equipment in a personal watercraft as in claim 13, wherein the foam is a closed cell foam.

16. A housing for electronic equipment in a personal watercraft as in claim 13, wherein the foam is a closed cell flotation foam.

17. A housing for electronic equipment in a personal watercraft as in claim 13, wherein the foam includes at least one hole entirely through the foam.

18. A housing for electronic equipment in a personal watercraft as in claim 17, wherein the foam includes at least one strap disposed through the at least one hole.

19. A housing for electronic equipment in a personal watercraft as in claim 13, wherein the foam includes at least one strap secured to he foam.

20. A housing for electronic equipment in a personal watercraft as in claim 19, wherein the strap secures upon itself using hook and loop type fasteners.

21. A housing for electronic equipment in a personal watercraft as in claim 13, wherein the foam includes cavities for at lest partially housing an engine capacitor.

22. A jet-propelled persons watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion;

a foam piece disposed within the hull, wherein the foam piece has a cavity therein for at least partially receiving a battery, wherein the cavity has a foam cavity floor; and a battery disposed directly within the foam cavity against the foam cavity floor.

23. A method for housing engine electronics equipment in a personal watercraft having a top deck secured to a bottom hull to form a hull interior within, the method comprising:

providing the personal watercraft;

providing a foam piece adapted to be disposed within the hull interior space, the foam piece having at least one battery cavity formed therein adapted to at least partially contain a battery, wherein the foam further comprises at least one engine electronics control box cavity adapted to at least partially contain an engine electronics control box; and disposing the foam piece within the hull.

24. A method for housing engine electronic equipment in a personal watercraft as in claim 23, further comprising at least partially inserting the battery in the battery cavity.

25. A method for housing engine electronic equipment in a personal watercraft as in claim 23, the method further comprising at least partially inserting the engine electronics control box in the engine electronic control box cavity.

26. A method for housing engine electronic equipment in a personal watercraft as in claim 23, wherein the foam piece is not attached to the bottom hull using fasteners that penetrate into the hull.

27. A method for housing engine electronic equipment in a personal watercraft as in claim 23, wherein the foam piece is shaped to match the bottom hull interior, and wherein the foam piece fits snuggly to the hull bottom interior without fasteners penetrating into the hull.

28. A jet-propelled personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion;

a foam piece disposed within the hull; and a battery secured to the foam piece disposed within the hull, wherein the battery is secured to the foam with at least one strap.

29. A jet-propelled personal watercraft as in claim 28, wherein the strap secures upon itself using hook and loop fasteners.

30. A housing for electronic equipment in a personal watercraft the housing comprising:

a foam piece adapted to be disposed within a hull, the foam piece having at least one battery cavity formed therein adapted to at least partially contain a battery, wherein the foam includes at least one hole entirely through the foam and opening into the battery cavity.

31. A housing for electronic equipment in a personal watercraft as in claim 30, wherein the foam includes at least one strap disposed through the at least one hole.

32. A housing for electronic equipment in a personal watercraft as in claim 30, wherein the foam includes at least one strap secured to the foam.

33. A housing for electronic equipment in a personal watercraft as in claim 31, wherein the strap secures upon itself using hook and loop type fasteners.

34. A housing for electronic equipment in a personal watercraft as in claim 30, wherein the foam includes a cavity for at least partially housing an engine capacitor.

35. A jet-propelled personal watercraft comprising:

a hull including a bottom hull and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat ted to accommodate an operator in straddle fashion;

a foam piece disposed within the hull, wherein the foam piece has a cavity therein for at least partially receiving a battery, wherein the cavity has a cavity floor and walls, wherein the watercraft has no rigid surface disposed between the battery and the foam cavity floor.

* * * * *